United States Patent [19]

Coe, Jr.

[11] Patent Number: 4,514,195

[45] Date of Patent: Apr. 30, 1985

[54] DISCHARGE ELECTRODE

[75] Inventor: Everett L. Coe, Jr., Downey, Calif.

[73] Assignee: Joy Manufacturing Company, Pittsburgh, Pa.

[21] Appl. No.: 603,978

[22] Filed: Apr. 25, 1984

Related U.S. Application Data

[60] Continuation of Ser. No. 192,589, Oct. 1, 1980, abandoned, which is a continuation of Ser. No. 946,925, Sep. 28, 1978, abandoned, which is a division of Ser. No. 788,171, Apr. 18, 1977, abandoned.

[51] Int. Cl.[3] ..... B03C 3/41

[52] U.S. Cl. ..... 55/152; 361/230

[58] Field of Search ..... 55/140, 145–148, 55/150–157; 361/225–235; 248/317; 250/326

[56] References Cited

U.S. PATENT DOCUMENTS

| | | | |
|---|---|---|---|
| 1,333,790 | 3/1920 | Bradley | 55/2 |
| 2,448,407 | 8/1948 | Antalek | 55/152 |
| 2,505,907 | 5/1950 | Meston | 55/152 |
| 3,126,575 | 3/1964 | Schoenberg | 248/317 |
| 3,158,453 | 11/1964 | Maartman et al. | 55/152 |
| 3,158,454 | 11/1964 | Gustafsson | 55/152 |
| 3,200,566 | 8/1965 | Gustafsson et al. | 55/152 |
| 3,257,749 | 6/1966 | Strubler | 55/140 |
| 3,616,608 | 11/1971 | Stevernagel et al. | 55/150 |
| 3,624,392 | 11/1971 | Kurahashi | 250/49.5 X |
| 3,660,968 | 5/1972 | Dyla et al. | 55/150 |
| 3,958,962 | 5/1976 | Hayashi | 55/2 |
| 3,985,524 | 10/1976 | Masuda | 55/152 |
| 4,071,688 | 1/1978 | Lynch et al. | 55/150 |

FOREIGN PATENT DOCUMENTS

| | | | |
|---|---|---|---|
| 245882 | 7/1963 | Australia | 55/150 |
| 401997 | 3/1970 | Australia | 55/152 |
| 1036507 | 7/1966 | United Kingdom | 55/152 |

*Primary Examiner*—David L. Lacey

*Attorney, Agent, or Firm*—Edward L. Levine

[57] ABSTRACT

Discharge electrodes for use in electrostatic precipitators. In preferred form a discharge electrode is formed of a pair of body elements arranged in a partially overlapping relationship. The overlapping structure is such that a longitudinally extending support portion is formed in the lateral intermediate portion of the electrode. To each side of the support portion a web portion is formed which includes one of the body elements extending the full lateral extent of the web portion and the other body element extending only part of the lateral extent of the web portion. The body element which extends on each side of the support the full lateral extent of the web portion, also extends to form the corona discharge portion on that lateral side of the electrode.

16 Claims, 10 Drawing Figures

DISCHARGE ELECTRODE

This application is a continuation of application Ser. No. 192,589, filed Oct. 1, 1980, now abandoned, which is a continuation of application Ser. No. 946,925 filed Sept. 28, 1978, now abandoned, which is a division of application Ser. No. 788,171 filed Apr. 18, 1977, now abandoned; U.S. Pat. No. 4,303,418 issued Dec. 1, 1981 on application Ser. No. 107,298 filed Dec. 26, 1979 which application is a continuation of said application Ser. No. 788,171.

In the art of gas cleansing by electrostatic precipitation it is well known to provide laterally spaced apart and oppositely charged discharge and collector electrode means within an electrostatic precipitator for the purpose of arresting particulate matter from a stream of gas passed therethrough. Among conventional discharge electrode means are the so-called pole or mast type electrodes which typically have been characterized by their elongated, formed structure including variously formed protrusions thereon to promote efficient corona discharge, for example as shown in U.S. Pat. Nos. 3,985,524, 3,200,566, 3,616,608, 3,158,453, 3,158,454, and 3,257,779 among many others.

Although known mast or pole type discharge electrodes have generally served the intended purposes they have nevertheless often been subject to serious deficiencies. For example, conventional electrode structures and particularly those formed in relatively thin sheet metal often have been subject to considerable lateral deflection as a result of periodic rapping or by their tendency to act as airfoils thus causing a pressure differential in the gas flowing at high velocity over the electrode. Excessive electrode deflection may result in arcing between adjacent discharge and collector electrodes thereby degrading dust collecting efficiency or causing localized burning of the electrodes. In the prior art, the requisite structural rigidity in such electrodes has been provided by such means as the use of heavier gauge sheet metal than would otherwise be required or by affixing additional structural members to the electrode. This approach seriously complicates electrode fabrication, results in unduly heavy and cumbersome electrodes and is unnecessarily wasteful of materials. Additionally, many prior mast or pole type discharge electrodes have included integrally formed stiffener means adjacent the electrode edges from which corona discharge emanates. Thus the design considerations for desirable corona discharge and for required structural rigidity have often been in conflict and the difficulty of optimizing the electrode design has been correspondingly increased.

Furthermore, the formed protrusions on prior electrodes constitute, in effect, point sources of corona emission whereby the resulting distribution of corona emission over the length of the electrode is quite nonuniform.

These and other deficiencies of prior mast type discharge electrodes are alleviated by the present invention according to which there is provided an elongated, formed discharge electrode having support or stiffener means formed integral therewith intermediate the corona emitting electrode edge portions. The electrode of this invention additionally offers improved corona propagating means and enhanced durability and simplicity of fabrication. These and other objects and advantages of the invention are more fully specified in the following description with reference to the accompanying figures, in which:

Figure 1:
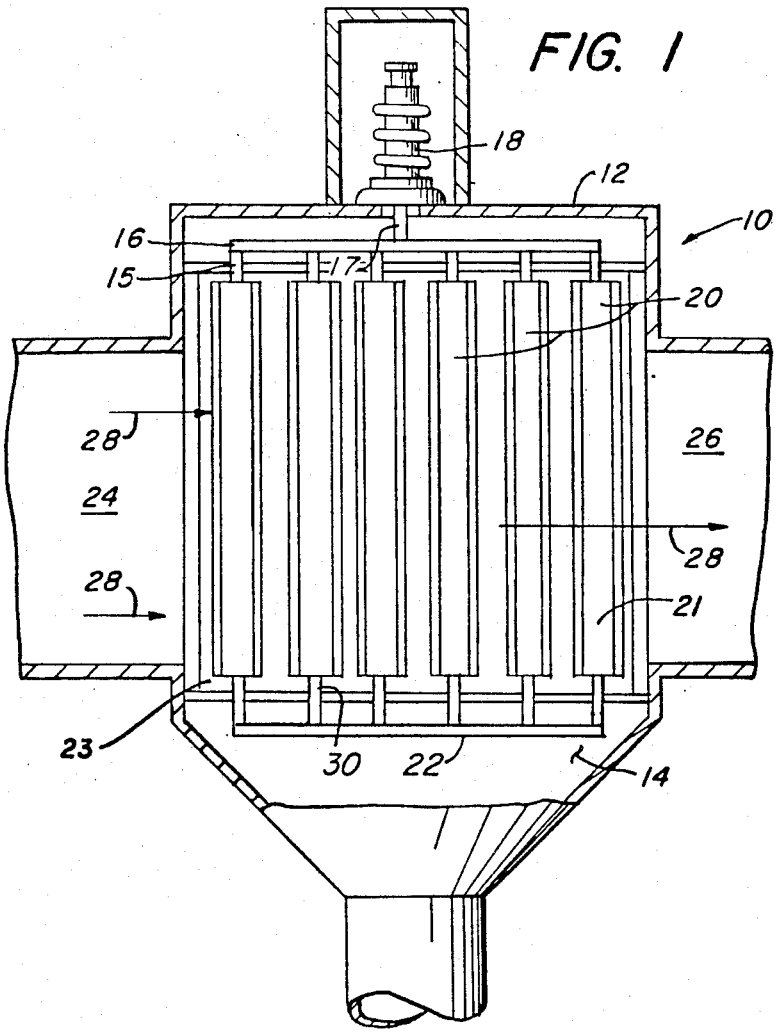
FIG. 1 is a schematic cross section of an electrostatic precipitator discharge electrode means of the present invention.

There is generally indicated at 10 in FIG. 1 an electrostatic precipitator including discharge electrode means constructed according to the principles of the present invention. For purposes of illustration the precipitator 10 is shown in simplified schematic form and of course it is to be understood from the outset that such simplification is not intended to unduly limit the scope of the invention described.

Precipitator 10 comprises a closed housing 12 which encloses a space 14 and includes gas inlet and outlet means 24, 26, respectively, whereby a flow of gas may be directed through space 14 as indicated by arrows 28 for cleansing. Within space 14 there is supported at least one discharge electrode bank 21 assembled from a plurality of discharge electrodes 20. Electrodes 20 are supported in generally vertically extending, parallel orientation by respective pairs of upper and lower electrode support members 15, 30 such that the electrodes 20 extend transversely across the gas flow path with the plane of each electrode 20 generally aligned with the direction of gas flow. Members 15, 30, supportingly and electrically conductively engage respective upper and lower end portions of the electrodes 20. The upper support members 15 are suitably secured to a rigid support frame 16. Frame 16 in turn is supported by and electrically insulated from housing 12 as by an elongated upwardly extending frame hanger member 17 which is supportingly engaged by a well known compression insulator 18 such that frame 16 and the electrode bank 21 supported thereby are suspended within the flow path of gas passed through space 14. Adjacent the lower ends of respective electrodes 20, the lower support members 30 are suitably secured to a base frame 22 which is electrically insulated from housing 12 as by the surrounding air space.

As is well known, there may be provided a plurality of generally parallel, laterally spaced electrode banks 21 within space 14 with conventional grounded collector electrode plates 23 also supported within space 14 intermediate respective pairs of adjacent discharge electrode banks 21 and parallel thereto whereby the discharge electrodes 20 may be electrically energized by any suitable means (not shown) to set up corona discharge therefrom in the space between each discharge electrode 20 and the respective adjacent collectors 23. Accordingly, in practice the gas stream passed through space 14 is cleansed by electrical precipitation of entrained particulate contaminants and deposition thereof on the collector electrode plates 23 in the well known manner. Conventional rapping techniques are employed to dislodge the accumulated contaminants from collector electrodes 23 for disposal. Inasmuch as electrostatic precipitators such as described hereinabove and the operation thereof are well known to those versed in the art, further detailed description thereof is considered unnecessary for an understanding of the present invention.

Figure 2:
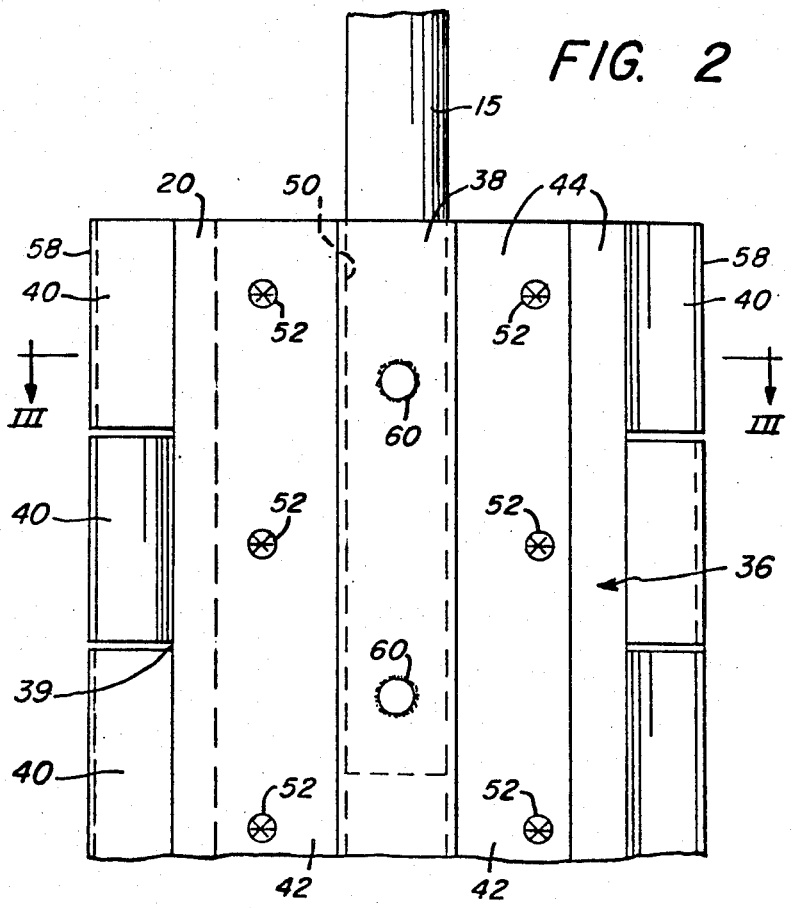
FIG. 2 is an enlarged fragmentary portion of FIG. 1 showing an upper end portion of a discharge electrode according to one preferred embodiment of the invention.
Figure 3:
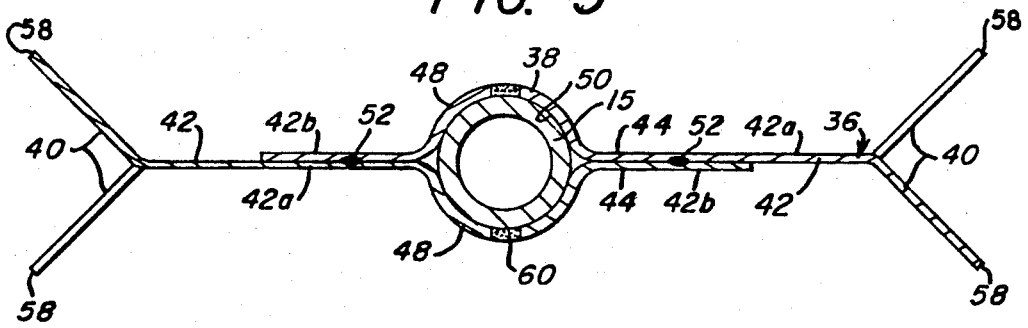
FIG. 3 is a transverse section of the electrode of FIG. 2 taken on line III—III of FIG. 2.

According to one preferred embodiment of the invention as shown in FIGS. 2 and 3, each electrode 20 includes an elongated, generally planar and substantially unitary electrode body 36 formed as by roll forming or similar processes and comprising: a central axially extending elongated stiffener or support portion 38 formed intermediate the transversely opposed longitudinal edges 58 of the body 36 and corona discharge portions shown as elongated tabs 40 formed adjacent respective edges 58 to define respective lines of corona emission extending therealong. Supporting web portions 42 extend intermediate respective tabs 40 and stiffener portion 38. The electrode portions 38, 40 and 42 ordinarily may be coextensive throughout substantially the entire length of body 36.

Stiffener portion 38 is so formed as to define a longitudinally extending opening 50 substantially coextensive therewith. The opening 50, shown as having a circular cross section, is adapted to have secured therewithin the cooperably formed support members 15 and 30 adjacent respective opposed end portions of body 36 (only the upper end portion is shown in FIG. 2) as by weldments 60 whereby members 15 and 30 are electrically conductively affixed to body 36. As shown in FIGS. 2 and 3, body 36 is comprised of two identical and generally planar elongated, formed plates 44, each being formed for example from No. 16 gauge steel to have a thickness of approximately 0.04 to 0.08 inches. Each plate 44 includes a longitudinally extending semicircular outward bend 48 intermediate the longitudinal edges thereof which forms one half of the stiffener portion 38, and a plurality of the longitudinally spaced tabs 40 spaced transversely to one side of bend 48 adjacent one longitudinal edge of each plate 44. In each plate 44, a longitudinal web porion **42*a* extends transversely intermediate the bend 48 and tabs 40, and a second elongated web portion 42*b* extends transversely outward from bend 48 generally coplanar with and in the opposite direction from web 42*a*. In assembly, two plates 44 are positioned adjacent one another so as to extend in generally parallel coplanar relation with the inner or concave sides of the bends 48 coaxially aligned and facing each other, and with the tabs 40 of each plate 44 being spaced laterally in opposite directions as shown in FIG. 3. The two plates 44 are affixed rigidly together in the position described as by a plurality of resistance weldments 52 spaced longitudinally at intervals to rigidly secure together adjacent web portions 42*a* and 42*b* such that the juxtaposed outward bends 48 form the stiffener portion 38 and opening 50. Of course, any suitable alternative fastening means may be employed in lieu of weldments 52**, for example other types of welding, threaded fasteners or rivets.

Longitudinally adjacent ones of tabs 40 are shown as being formed by intervening slots 39 and as shown may be bent or outstruck alternately in opposite directions from the plane of web portion 42 at an angle of approximately 45 degrees, for example such that alternate tabs 40 provide corona emission to the collector plates 23 on opposite sides of the discharge electrode 20. Of course, the particular angle, shape and size of tabs 40 may be varied to achieve the most desirable and efficient pattern of corona emission therefrom. For example, in another preferred embodiment of this invention which is described in detail hereinbelow tabs 40 may be substantially coplanar with web 42 such that corona will propagate from each tab to the collector plates 23 on both sides of the discharge electrode. In any case, one desirable property in the discharge electrode of this invention is that the pattern of corona discharge to collectors on opposite sides of the discharge electrode be generally symmetrical about the plane of the discharge electrode. By this it is meant that approximately equal corona discharge propagates from one edge of the electrode 20 to each of the adjacent collector electrodes 23.

Figure 4:
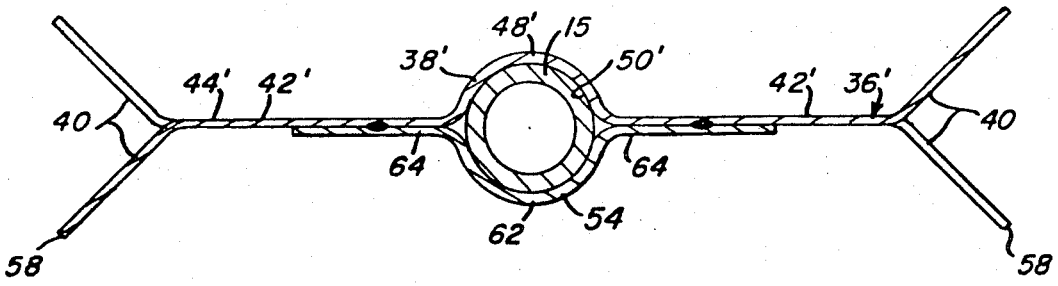
FIG. 4 is a transverse section similar to FIG. 3 showing a variation of the embodiment of FIG. 3.

FIG. 4 illustrates a variation of the embodiment of FIGS. 2 and 3 wherein electrode body 36' is comprised of a generally planar elongated formed plate 44' having a formed semi-circular outward bend 48' which extends longitudinally of plate 44' and is located centrally intermediate opposed longitudinal edges 58 thereof. Corona discharge means such as outstruck tabs 40 are formed adjacent the edges 58 of plate 44' and identical coplanar web portions 42' extend intermediate the bend 48' and respective tabs 40. According to this embodiment an elongated stiffener portion 38', including an elongated cylindrical opening 50' adapted to receive support members 15 and 30, is formed by bend 48' in cooperation with an elongated, formed means shown as a member 54 having an elongated semi-circular outward bend 62 formed intermediate transversely extending coplanar web portions 64 thereof. The members 44' and 54 are positioned with the respective inner or concave sides of bends 48' and 62 facing each other and coaxially aligned to form the stiffener portion 38' and opening 50' in the manner indicated hereinabove for the first described embodiment, and the respective web portions 64 and 42' are affixed rigidly together in any suitable manner as hereinabove described to form the substantially unitary body 36'. Elongated means 54 may be comprised of a plurality of distinct members affixed at longitudinally spaced intervals along the member 44' if desired.

Figure 6:
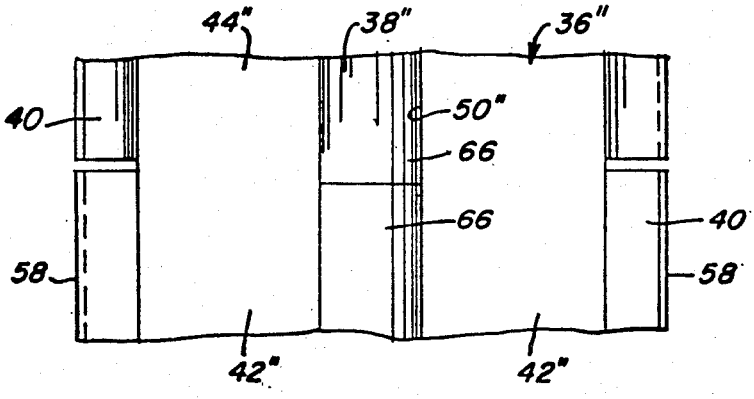
FIG. 6 is a partial side elevation taken on line VI—VI of FIG. 5.
Figure 5:
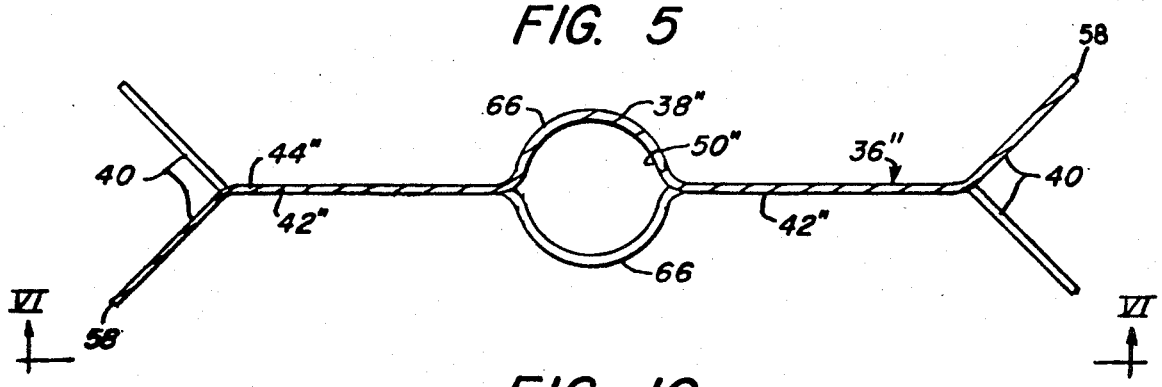
FIG. 5 is a transverse section similar to FIGS. 3 and 4 showing yet another variation of the embodiment of FIG. 3.

Another variation on the embodiment of FIGS. 2 and 3 is shown in FIGS. 5 and 6 wherein electrode body 36'' comprises a single, elongated, generally planar formed member 44'' having an elongated stiffener portion 38'' and identical, coplanar web portions 42'' extending transversely in opposite directions therefrom. Tabs 40 are formed adjacent respective opposed outer edges 58 of member 44''. According to this embodiment, a cylindrical opening 50'' to receive support members 15 and 30 is formed by a plurality of longitudinally adjacent segments 66 of stiffener portion 38'' being outwardly formed alternately in opposite directions.

In each of the hereinabove and hereinbelow described variations, the stiffener portions 38, 38' and 38'' are suitably formed and dimensioned to provide the structural rigidity considered sufficient to render the electrode body 36, 36' and 36'' substantially self supporting in that only the end support members 15 and 30 are needed to support the electrode and that portion of the electrode body extending longitudinally intermediate the respective electrode body ends has no support means other than its own formed structure. The openings 50, 50' and 50'' as described may be substantially coextensive with stiffeners 38, 38' and 38'' whereby if desired the support members 15 and 30 may be longitudinally opposed end portions of a single elongated member disposed within the opening 50 and extending throughout the length of body 36 to provide added structural rigidity therefor. If members 15 and 30 engage only the opposed end portions of the body 36, the stiffener portion 38 intermediate the end portions engaging members 15 and 30 need not necessarily be formed to include the opening 50, for example as in the hereinbelow described embodiment.

Figure 9:
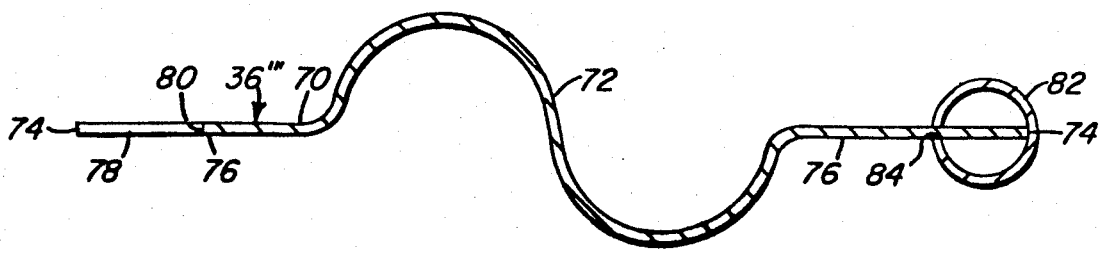
FIG. 9 is a transverse cross section taken on line IX—IX of FIG. 7.
Figure 10:
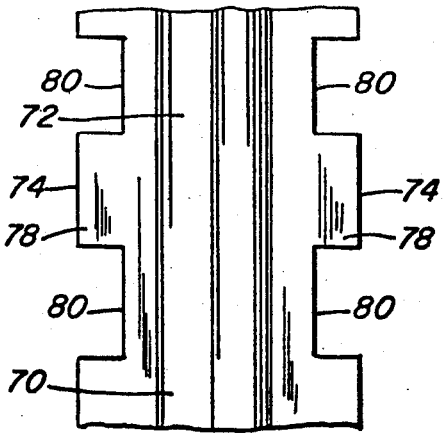
FIG. 10 is an elevation similar to FIG. 7 showing a variation of the embodiment of FIG. 7.
Figure 8:
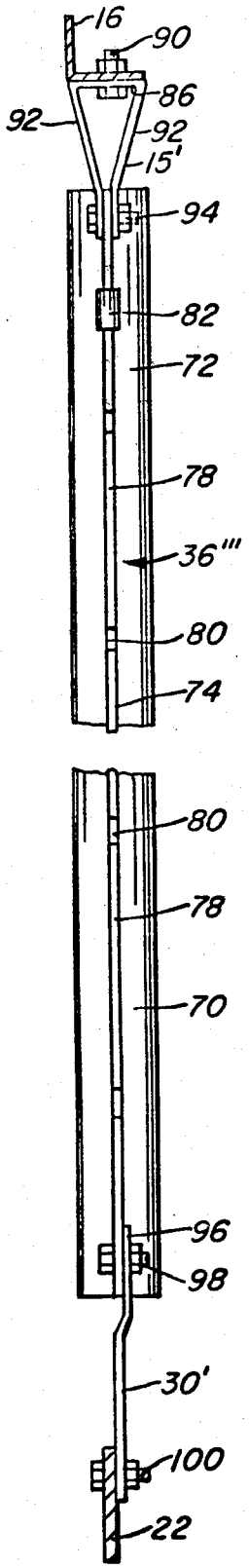
FIG. 8 is an elevation taken on line VIII—VIII of FIG. 7.
Figure 7:
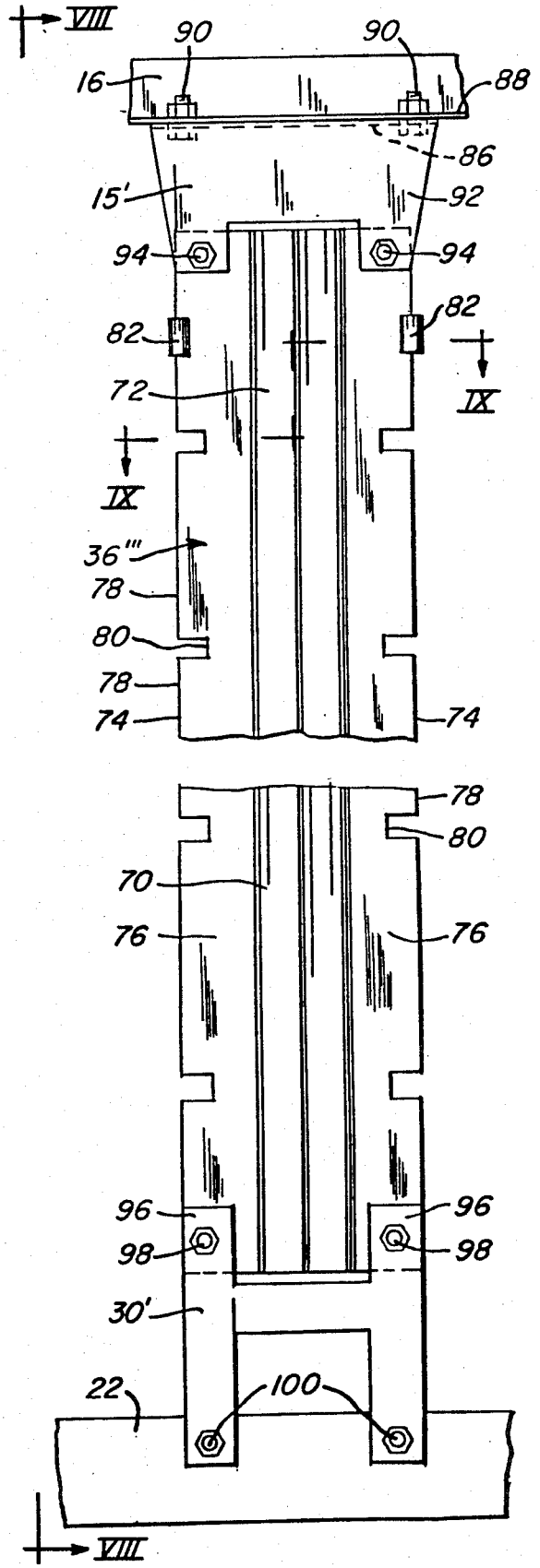
FIG. 7 is a partial side elevation of another preferred embodiment of the invention.

In FIGS. 7, 8 and 9, there is shown another preferred embodiment of the invention wherein the electrode body 36''' includes a formed plate member 70 having a generally serpentine or S-curved longitudinally extending stiffener portion 72 formed laterally intermediate the longitudinal edges 74 thereof. Generally coplanar side portions 76 of plate 70 are spaced laterally to either side of stiffener portion 72 and each has formed therein corona discharge means such as a plurality of longitudinally spaced tabs 78 and intervening notches 80. The corona discharge tabs 78 may be coplanar with each other and with side portions 76 as shown or may be alternately outstruck as described hereinabove. The dimensions and spacing of notches 80 may be varied to alter the current-voltage characteristics and hence the corona discharge characteristics of the electrode. For example, it may be desirable that the electrode 20 have a current-voltage characteristic approximating that of a pair of laterally spaced, parallel-wire discharge electrodes. One suitable configuration is shown in FIG. 10 wherein the longitudinal extent of tabs 78 is approximately equal to the longitudinal extent of notches 80. A similar configuration results from the tabs in the embodiment of FIG. 3 being of substantially equal longitudinal extent and being outstruck in opposite directions. It should be noted, however, that in general the longer the notches 80 are in relation to the length of the tabs 78, the more the corona propagation from the electrode will deviate from longitudinal uniformity. As notches 80 are lengthened and tabs 78 correspondingly shortened, the corona propagation pattern will approach that of plural, longitudinally spaced discharge points. In a variation of the FIG. 10 configuration (not shown) the alternate notches 80 and tabs 78 formed in the opposite edges 74 of plate 70 may be longitudinally offset or staggered in such a manner that each tab 78 in one edge 74 is transversely aligned with a notch 80 formed in the opposite edge 74. In an alternate embodiment the corona discharge means may be comprised of a continuous edge portion of the discharge electrode having no cutouts or notches therein.

If corona emission from the discharge electrodes must be curtailed, as for example to promote the uniform current flow or corona discharge to the collectors near the upper and lower ends of the body 36 whereat edges 74 are disposed laterally adjacent corresponding edge portions of collector plates 23, electrically conductive shroud means 82 may be employed as shown to "soften" the contour of the electrode thereat by eliminating exposed edge portions and curtailing corona discharge from the covered edge portions. As shown, shrouds 82 may be formed as elongated, generally tubular members each having a longitudinally extending through slot 84 which receives the edge 74 of plate 70 whereby the edges of slot 84 grip plate 70 to secure the shroud 82 thereto.

The formed plate member 70 extends intermediate frames 16, 22 and is secured thereto by respective upper and lower support members 15', 30'. As shown, support member 15' comprises a formed body having a transversely extending upper body portion 86 by which the support 15' is releasably secured to a cooperably formed lower portion 88 of frame 16 as by threaded fasteners 90, and a pair of inwardly and downwardly converging side portions 92 the lower ends of which receive the respective upper ends of electrode side portions 76 therebetween for securing thereof as by threaded fasteners 94. In similar fashion an upwardly extending end portion 96 of generally H-shaped, elongated, lower alignment support 30' is secured by threaded fasteners 98 to the lower ends of respective electrode side portions 76, and the lower end of support 30' is secured by threaded fasteners 100 to frame 22.

According to the description hereinabove, there is provided by the instant invention an improved discharge electrode of the pole or mast type for electrostatic precipitators which is uncomplicated in fabrication and assembly, highly durable and sufficiently rigid by virtue of integrally formed stiffener portions therein to resist excess lateral deflections without being wasteful of materials in fabrication.

Although only certain preferred embodiments of the invention have been described herein it is to be understood that the invention may be practiced in numerous alternative embodiments with various modifications thereto without departing from the broad spirit and scope thereof. For example: openings may be formed in web portions 42 to provide a lighter weight electrode assembly; the support members 15 and 30 may comprise tubular members or solid bars of any suitable cross section with the cross section of respective openings 50 being cooperably formed; the tabs 40 may be formed and positioned according to any of numerous suitable designs, for example a sawtooth configuration; the electrodes may be assembled from plural elongated electrode portions connected end to end; an electrode may combine elements of the several described embodiments in a single structure; and the like. These and other embodiments and modifications have been envisioned and anticipated by the inventor, this invention should be interpreted as broadly as permitted by the scope of the claims appended hereto.

I claim:

1. A discharge electrode assembly for use in an electrostatic precipitator for propagation of corona discharge wherein said discharge electrode assembly includes an elongated support portion which is substantially longitudinally coextensive with at least a major portion of the longitudinal extent of said electrode assembly and is located laterally intermediate a pair of laterally spaced apart longitudinal side portions of said assembly, said electrode assembly comprising: a pair of elongated formed body elements each substantially longitudinally coextensive with at least a major portion of the longitudinal extent of said electrode assembly; each of said body elements including a pair of laterally spaced apart edge portions longitudinally coextensive therewith and an elongated formed intermediate portion substantially coextensive therewith and spaced laterally from at least one of said pair of edge portions;

said pair of body elements being maintained in mutually juxtaposed laterally overlapping relationship with respect to each other to form said electrode assembly in a manner that one of said edge portions of each said body element extends laterally outward of the overlapping portions of said body elements to form the laterally outermost extent of a respective one of said side portions and the respective formed intermediate portions of said body elements cooperate to form said elongated support portion; and at least one of said body elements including longitudinally extending corona discharge means formed integrally therewith adjacent the respective said one edge portion thereof and spaced laterally from said elongated support portion, said discharge means extending at least a major portion of the longitudinal extent of said electrode assembly.

2. A discharge electrode assembly as claimed in claim 1 wherein said elongated support portion is of a generally serpentine cross sectional form.

3. A discharge electrode assembly as claimed in claim 1 wherein said corona discharge means and said formed intermediate portion are formed integrally with the respective said body elements.

4. A discharge electrode assembly as claimed in claim 1 additionally including shroud means removably secured thereto adjacent selected longitudinal extents of said corona discharge means for curtailing corona discharge therefrom.

5. A discharge electrode assembly as claimed in claim 1 wherein said corona discharge means includes longitudinally extending pluralities of elongated tabs and intervening notches.

6. A discharge electrode assembly as claimed in claim 5 wherein said corona discharge means and the respective said at least one of said side portions are substantially coplanar.

7. A discharge electrode assembly as claimed in claim 5 wherein said corona discharge means is substantially symmetrical with respect to a plane aligned with the lateral extent of said respective one of said side portions.

8. A discharge electrode assembly as claimed in claim 7 wherein alternate ones of said tabs are outstruck to opposite sides of said plane.

9. A discharge electrode assembly as claimed in claim 8 wherein the longitudinal extent of at least some of said tabs is at least as great as the longitudinal extent of one of the respective said intervening notches longitudinally adjacent thereto.

10. A discharge electrode assembly as claimed in claim 9 wherein said at least some of said tabs is a majority of said tabs.

11. A discharge electrode assembly as claimed in claim 1 wherein said elongated support portion is of a generally circular cross sectional form.

12. A discharge electrode assembly as claimed in claim 11 wherein said formed intermediate portion of each of said body elements includes a longitudinally extending generally semi-circular bend in the respective said body element.

13. A discharge electrode assembly as claimed in claim 1 wherein said body elements are substantially identical.

14. A discharge electrode assembly for use in an electrostatic precipitator to propagate corona discharge comprising: a pair of elongated formed body elements juxtaposed with portions thereof disposed in laterally overlapping relationship to form said electrode assembly; each of said body elements including a pair of laterally spaced apart longitudinal edge portions and a formed intermediate portion extending longitudinally thereof and spaced laterally from at least one of said pair of edge portions; said laterally overlapping relationship being such that one of said edge portions of each said body element extends laterally outward of said laterally overlapping portions of said body elements and the other of said edge portions of each said body element is of an extent terminating laterally inward of said one of said edge portions which extends laterally outward of said laterally overlapping portions, and the respective formed intermediate portions of said body elements form a longitudinally extending support portion of said electrode assembly located laterally intermediate said longitudinal edges thereof; said edge portions being generally longitudinally coextensive with at least a major portion of the longitudinal extent of said electrode assembly; and at least one of said body elements including corona discharge means extending longitudinally thereof adjacent the respective said one edge portion thereof, said discharge means extending at least a major portion of the longitudinal extent of said discharge electrode assembly.

15. The discharge electrode assembly as claimed in claim 14 wherein said corona discharge means is spaced laterally outwardly from said laterally overlapping portions.

16. In a corona discharge electrode for use in an electrostatic precipitator and comprised of a pair of juxtaposed formed body elements, said juxtaposed body elements positioned with respect to one another to provide at least a part of said discharge electrode, each said body element comprising:

an elongated formed member having a lateral extent transverse of the longitudinal extent thereof defined by a pair of laterally spaced apart longitudinal side portions; said formed member having a formed intermediate portion extending longitudinally thereof intermediate said longitudinal side portions and corona discharge means including longitudinal edges and intervening notches extending adjacent one longitudinal side portion thereof and extending at least a major portion of the longitudinal extent of said discharge electrode; said formed member being configured for laterally overlapping juxtaposition thereof with another like formed member to provide such discharge electrode with the laterally overlapping juxtaposition being such that said one side portion of each said formed member extends laterally outward of the laterally overlapping portions thereof, and said formed intermediate portions cooperate to form an elongated electrode support means extending longitudinally of such discharge electrode intermediate the longitudinal side portions thereof, said side portions being substantially longitudinally coextensive with at least a major portion of the longitudinal extent of said discharge electrode.

* * * * *

UNITED STATES PATENT AND TRADEMARK OFFICE

CERTIFICATE OF CORRECTION

PATENT NO. : 4,514,195

DATED : April 30, 1985

INVENTOR(S) : Everett L. Coe, Jr.

It is certified that error appears in the above-identified patent and that said Letters Patent are hereby corrected as shown below:

Column 2, line 4 after "precipitator" insert -- including --

Signed and Sealed this

*Thirteenth* Day of *August 1985*

[SEAL]

*Attest:*

DONALD J. QUIGG

*Attesting Officer* *Acting Commissioner of Patents and Trademarks*